US008615188B2

(12) United States Patent
Moorlag et al.

(10) Patent No.: US 8,615,188 B2
(45) Date of Patent: Dec. 24, 2013

(54) METHOD OF CONTROLLING GLOSS

(75) Inventors: Carolyn P. Moorlag, Mississauga (CA); Edward G. Zwartz, Mississauga (CA); Gordon Sisler, St. Catharines (CA); Kurt I. Halfyard, Mississauga (CA); Yu Qi, Oakville (CA); Sandra J. Gardner, Oakville (CA); T. Brian McAneney, Burlington (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 263 days.

(21) Appl. No.: 13/053,423

(22) Filed: Mar. 22, 2011

(65) Prior Publication Data

US 2012/0243924 A1 Sep. 27, 2012

(51) Int. Cl.
*G03G 15/20* (2006.01)

(52) U.S. Cl.
USPC ..... 399/333; 430/124.3

(58) Field of Classification Search
USPC ..... 399/333, 330, 328, 329; 347/156; 430/124.3, 124.32, 124.33, 124.35
See application file for complete search history.

(56) References Cited

U.S. PATENT DOCUMENTS

| | | | | |
|---|---|---|---|---|
| 4,451,634 | A * | 5/1984 | Hatanaka et al. | 522/60 |
| 4,711,818 | A * | 12/1987 | Henry | 428/421 |
| 5,363,180 | A | 11/1994 | Shimizu et al. | |
| 5,666,592 | A | 9/1997 | Aslam et al. | |
| 5,709,973 | A | 1/1998 | Chen et al. | |
| 5,716,750 | A | 2/1998 | Tyagi et al. | |
| 5,729,813 | A | 3/1998 | Eddy et al. | |
| 5,887,235 | A | 3/1999 | Wayman et al. | |
| 6,087,729 | A | 7/2000 | Cerofolini et al. | |
| 6,101,345 | A | 8/2000 | Van Goethem et al. | |
| 6,113,830 | A | 9/2000 | Chen et al. | |
| 6,438,336 | B1 | 8/2002 | Bengtson | |
| 6,927,006 | B2 | 8/2005 | Finn et al. | |
| 6,983,119 | B2 | 1/2006 | Nakayama | |
| 7,088,946 | B2 | 8/2006 | Behnke et al. | |
| 7,395,021 | B2 | 7/2008 | Tamura et al. | |
| 7,754,121 | B2 | 7/2010 | Ristic-Lehmann et al. | |
| 8,029,871 | B2 | 10/2011 | Nakayama et al. | |
| 8,135,324 | B2 | 3/2012 | Moorlag | |
| 2001/0034158 | A1* | 10/2001 | Matsubara | 439/578 |
| 2003/0207078 | A1 | 11/2003 | Finn et al. | |
| 2004/0034158 | A1 | 2/2004 | Reuter et al. | |

(Continued)

OTHER PUBLICATIONS

U.S. Appl. No. 13/053,418, filed Mar. 22, 2011, Office Action dated Apr. 17, 2012.

(Continued)

*Primary Examiner* — Sophia S Chen
(74) *Attorney, Agent, or Firm* — Hoffman Warnick LLC

(57) ABSTRACT

The present teachings provide a fusing method and system of tuning gloss level on a copy substrate. The method includes obtaining an image forming apparatus for forming images on a recording medium including a charge-retentive surface to receive an electrostatic latent image thereon. The method includes applying toner to the charge-retentive surface to develop an electrostatic latent image to form a developed image on the charge-retentive surface. The developed image is transferred from the charge retentive surface to a copy substrate. The toner images are fused to a surface of the copy substrate. The gloss is adjusted on the copy substrate by providing a fuser member having a surface layer a fluoroplastic matrix having dispersed therein aerogel particles wherein the greater a weight percent of the aerogel particles in the fluoroplastic matrix the lower the gloss.

20 Claims, 6 Drawing Sheets

(56) References Cited

U.S. PATENT DOCUMENTS

| | | | | |
|---|---|---|---|---|
| 2005/0100728 | A1 | 5/2005 | Ristic-Lehmann et al. | |
| 2007/0231615 | A1 | 10/2007 | Tsujimoto et al. | |
| 2008/0070041 | A1* | 3/2008 | Kuntz et al. | 399/333 X |
| 2008/0241415 | A1 | 10/2008 | Stelter et al. | |
| 2008/0311398 | A1* | 12/2008 | Bauer et al. | 428/402 |
| 2009/0247648 | A1 | 10/2009 | Zhao | |
| 2010/0226701 | A1 | 9/2010 | Moorlag | |
| 2012/0244469 | A1* | 9/2012 | Zwartz et al. | 399/333 X |

OTHER PUBLICATIONS

U.S. Appl. No. 13/182,015, filed Jul. 13, 2011.
U.S. Appl. No. 13/053,730, filed Mar. 22, 2011.
"Dow Corning VM-2270 Aerogel Fine Particles" Dow Corning Corporation 2008.
Buie-Hatcher, Final Office Action, U.S. Appl. No. 13/053,418, Sep. 19, 2012.
U.S. Appl. No. 13/053,418, Notice of Allowance and Fees Due dated Dec. 28, 2012.
U.S. Appl. No. 13/251,364, Office Action dated Apr. 11, 2013.
U.S. Appl. No. 13/288,494, *Ex Parte Quayle* dated Apr. 17, 2013.
U.S. Appl. No. 13/448,822, Office Action dated Jun. 7, 2013.
Roberts, "Resonant Acoustic Mixing", Resodyn Acoustic Mixers, Nov. 6, 2011, pp. 1-8.
"Spectral Series Fumed Alumina for Power Coating Processes", Cabot Corporation, MA, USA, 2005, pp. 1-2.

* cited by examiner

SEM IMAGES OF SURFACE OF FLIMS AND PRINT SAMPLES
FROM PFA CONTROL AND PFA/2.5% AEROGEL

METHOD OF CONTROLLING GLOSS

CROSS REFERENCE TO RELATED APPLICATIONS

This application relates to commonly assigned copending application Ser. No. 13,053,418, filed simultaneously herewith and incorporated by reference herein in its entirety.

BACKGROUND

1. Field of Use

The present teachings relate generally to coating materials for electrophotographic devices and processes and, more particularly, to coating materials that contain aerogel fillers for providing controllable image gloss levels.

2. Background

Electrophotographic marking is performed by exposing a light image representation of a desired document onto a substantially uniformly charged photoreceptor. In response to that light image, the photoreceptor discharges to create an electrostatic latent image of the desired document on the photoreceptor's surface. Toner particles are then deposited onto that latent image to form a toner image. That toner image is then transferred from the photoreceptor onto a print medium such as a sheet of paper. The transferred toner image is then fused to the print medium, usually using heat and/or pressure.

Gloss is a property of a surface that relates to specular reflection. Specular reflection is a sharply defined light beam resulting from reflection off a smooth, uniform surface. Gloss follows the law of reflection which states that when a ray of light reflects off a surface, the angle of incidence is equal to the angle of reflection. Gloss properties are generally measured in gardner gloss units (ggu) by a gloss meter.

Currently, there is a need to provide options for the level of gloss on prints. Changing the fuser speed or fuser roll temperature can provide only a narrow range of gloss levels, and adding extra hardware to machines (e.g. dual fusers) is expensive. The approach to adjust print gloss by varying the molecular weight of the resins in toner materials is also time consuming and expensive. Changing toner may be convenient for some customers, but inconvenient for some customers requiring frequent changes in gloss setting.

Customers can also purchase additional equipment and apply a varnish/overcoat across the print. Different gloss levels for varnish are available to achieve this varying gloss for different print runs. The additional piece of equipment is costly.

It would be desirable to provide a method of controlling gloss that avoids changing fuser roll speeds, fuser temperature or toner or providing an additional piece of equipment.

SUMMARY

According to an embodiment there is provided a method of tuning gloss level on a copy substrate. The method includes obtaining an image forming apparatus for forming images on a recording medium comprising a charge-retentive surface to receive an electrostatic latent image thereon. The method includes applying toner to the charge-retentive surface to develop an electrostatic latent image to form a developed image on the charge-retentive surface. The method includes transferring the developed image from the charge retentive surface to a copy substrate and. fusing toner images to a surface of the copy substrate. The gloss on the copy substrate is adjusted by providing a fuser member having a surface layer comprising a fluoroplastic matrix having dispersed therein aerogel particles wherein the greater a weight percent of the aerogel particles in the fluoroplastic matrix the lower the gloss.

According to another embodiment there is provided a fusing system. The fusing system includes a fuser member comprising a gloss-controlling surface layer wherein the surface layer comprises a fluoroplastic matrix having dispersed therein aerogel particles wherein the aerogel particles comprise from about 0.5 weight percent to about 5.0 weight percent of the surface layer. The fusing system includes a pressure member configured to form a nip with the fuser member surface layer to fuse images on a substrate that passes through the nip wherein the fused images on the substrate have a gloss level ranging from 99 about ggu to 10 about ggu.

According to another embodiment there is provided a fusing method. The fusing method comprises passing a substrate between a fusing member and a pressure member wherein the fusing member comprises a surface layer comprising a fluoroplastic matrix having dispersed therein silca aerogel particles. The aerogel particles comprise from about 0.5 weight percent to about 2.5 weight percent of the surface layer such that a toner image is fused onto the substrate wherein the fused toner image comprises a gloss level ranging from about 90 ggu to about 10 ggu

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the FIGS. have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Illustrations with respect to one or more implementations, alterations and/or modifications can be made to the illustrated examples without departing from the spirit and scope of the appended claims. In addition, while a particular feature may have been disclosed with respect to only one of several implementations, such features may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
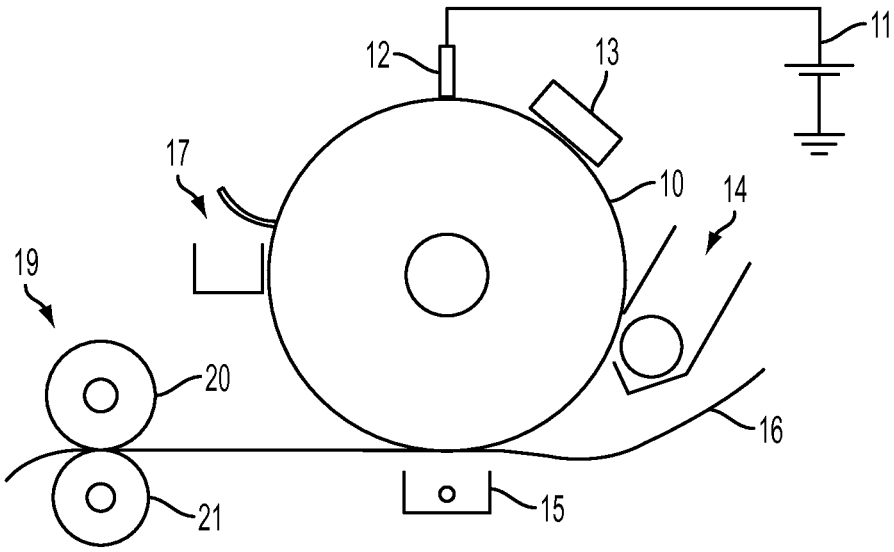
FIG. 1 is a schematic illustration of an image apparatus.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles, which are commonly referred to as toner. Specifically, a photoreceptor 10 is charged on its surface by means of a charger 12, to which a voltage has been supplied from a power supply 11. The photoreceptor 10 is then imagewise exposed to light from an optical system or an image input apparatus 13, such as a laser and light emitting diode, to form an electrostatic latent image thereon. Generally, the electrostatic latent image is developed by bringing a developer mixture from a developer station 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface in image configuration, they are transferred to a copy sheet 16 by a transfer means 15, which can be pressure transfer or electrostatic transfer. Alternatively, the developed image can be transferred to an intermediate transfer member, or bias transfer member, and subsequently transferred to a copy sheet. Examples of copy substrates include paper, transparency material such as polyester, polycarbonate, or the like, cloth, wood, or any other desired material upon which the finished image will be situated.

After the transfer of the developed image is completed, copy sheet 16 advances to a fusing station 19, depicted in FIG. 1 as a fuser roll 20 and a pressure roll 21 (although any other fusing components such as fuser belt in contact with a pressure roll, fuser roll in contact with pressure belt, and the like, are suitable for use with the present apparatus), wherein the developed image is fused to copy sheet 16 by passing copy sheet 16 between the fusing and pressure members, thereby forming a permanent image. Alternatively, transfer and fusing can be effected by a transfix application.

Subsequent to transfer, photoreceptor 10 advances to a cleaning station 17, wherein any toner left on photoreceptor 10 is cleaned therefrom by use of a blade (as shown in FIG. 1), brush, or other cleaning apparatus.

Figure 2:
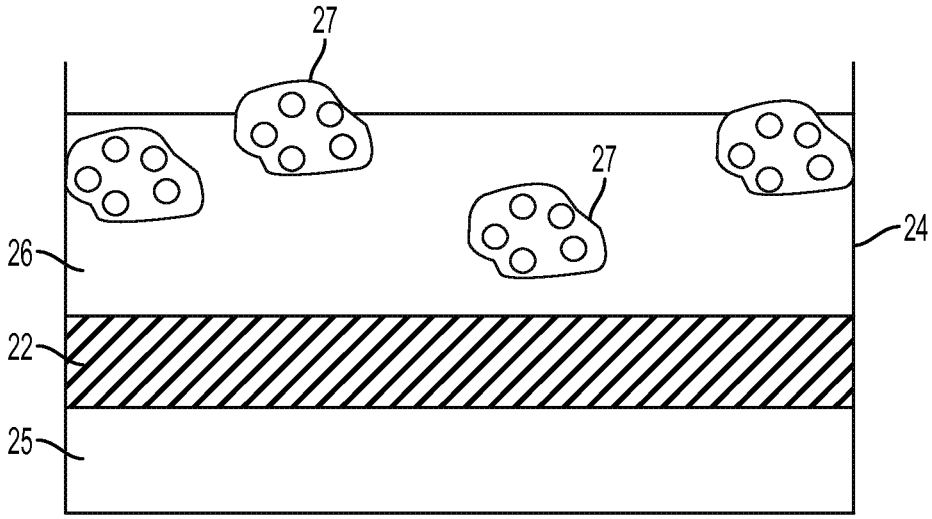
FIG. 2 is a schematic of an embodiment of a fuser member.

FIG. 2 is an enlarged schematic view of an embodiment of a fuser member, demonstrating the various possible layers. As shown in FIG. 2, a substrate 25 has an optional intermediate layer 22 thereon. On intermediate layer 22 is positioned a release layer 24, described in more detail below.

Substrate Layer

The substrate 25 in FIG. 2 can be in a form of, for example, a belt, plate, and/or cylindrical drum for the disclosed fuser member. The substrate of the fusing member is not limited, as long as it can provide high strength and physical properties that do not degrade at a fusing temperature. Specifically, the substrate can be made from a metal, such as aluminum or stainless steel or a plastic of a heat-resistant resin. Examples of the heat-resistant resin include a polyimide, an aromatic polyimide, polyether imide, polyphthalamide, polyester, and a liquid crystal material such as a thermotropic liquid crystal polymer and the like. The thickness of the substrate falls within a range where rigidity and flexibility enabling the fusing belt to be repeatedly turned can be compatibly established, for instance, ranging from about 10 to about 200 micrometers or from about 30 to about 100 micrometers.

Intermediate Layer

Examples of materials used for the functional intermediate layer 22 (also referred to as a cushioning layer) include fluorosilicones, silicone rubbers such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC® 735 black RTV and SILASTIC® 732 RTV, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include siloxanes (such as polydimethylsiloxanes); fluorosilicones such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC® 590 LSR, SILASTIC® 591 LSR, SILASTIC® 595 LSR, SILASTIC® 596 LSR, and SILASTIC® 598 LSR from Dow Corning. The functional layers provide elasticity and can be mixed with inorganic particles, for example SiC or $Al_2O_3$, as required.

Other examples of the materials suitable for use as intermediate layer 22 also include fluoroelastomers. Fluoroelastomers are from the class of 1) copolymers of two of vinylidenefluoride, hexafluoropropylene, and tetrafluoroethylene; 2) terpolymers of vinylidenefluoride, hexafluoropropylene, and tetrafluoroethylene; and 3) tetrapolymers of vinylidenefluoride, hexafluoropropylene, tetrafluoroethylene, and a cure site monomer. These fluoroelastomers are known commercially under various designations such as VITON A®, VITON B®, VITON E®, VITON E 60C®, VITON E430® VITON 910® VITON GH®; VITON GF®; and VITON ETP®. The VITON® designation is a Trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS™ a poly(propylene-tetrafluoroethylene), and FLUOREL II® (LII900) a poly(propylene-tetrafluoroethylenevinylidenefluoride), both also available from 3M Company, as well as the Tecnoflons identified as FOR-60KIR, FOR-LHF® NM® FOR-THF®, FOR-TFS® TH® NH®, P757, TNS®, T439, PL958®, BR9151® and TN505, available from Ausimont.

Examples of three known fluoroelastomers are (1) a class of copolymers of two of vinylidenefluoride, hexafluoropropylene, and tetrafluoroethylene, such as those known commercially as VITON A®; (2) a class of terpolymers of vinylidenefluoride, hexafluoropropylene, and tetrafluoroethylene known commercially as VITON B®; and (3) a class of tetrapolymers of vinylidenefluoride, hexafluoropropylene, tetrafluoroethylene, and a cure site monomer known commercially as VITON GH® or VITON GF®.

The fluoroelastomers VITON GH® and VITON GF® have relatively low amounts of vinylidenefluoride. The VITON GF® and VITON GH® have about 35 weight percent of vinylidenefluoride, about 34 weight percent of hexafluoropropylene, and about 29 weight percent of tetrafluoroethylene, with about 2 weight percent cure site monomer.

The thickness of the functional intermediate layer 22 is from about 30 microns to about 1,000 microns, or from about 100 microns to about 800 microns, or from about 150 to about 500 microns.

Adhesive Layer(s)

Optionally, any known and available suitable adhesive layer, also referred to as a primer layer, may be positioned between the release layer 24, the intermediate layer 22 and the substrate 25. Examples of suitable adhesives include silanes such as amino silanes (such as, for example, HV Primer 10 from Dow Corning), titanates, zirconates, aluminates, and the like, and mixtures thereof. In an embodiment, an adhesive in from about 0.001 percent to about 10 percent solution can be wiped on the substrate. The adhesive layer can be coated on the substrate, or on the outer layer, to a thickness of from about 2 nanometers to about 2,000 nanometers, or from about 2 nanometers to about 500 nanometers. The adhesive can be coated by any suitable known technique, including spray coating or wiping.

Release Layer

An exemplary embodiment of a release layer 24 includes a fluoroplastic 26 having dispersed therein aerogel particles 27. Fluoroplastics suitable for use in the formulation and release layer 24 described herein include fluoropolymers comprising a monomeric repeat unit that is selected from the group consisting of vinylidene fluoride, hexafluoropropylene, tetrafluoroethylene, perfluoroalkylvinylether, and mixtures thereof. Examples of fluoroplastics include polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP), and mixtures thereof. The fluoroplastic provides chemical and thermal stability and has a low surface energy. The fluoroplastic has a melting temperature of from about 100° C. to about 350° C. or from about 120° C. to about 330° C.

Any suitable aerogel component can be used. In embodiments, the aerogel component can be, for example, selected from inorganic aerogels, organic aerogels, carbon aerogels, and mixtures thereof. In particular embodiments, ceramic aerogels can be suitably used. These aerogels are typically composed of silica, but may also be composed of metal oxides, such as alumina, titania and zirconia, or carbon, and can optionally be doped with other elements such as a metal. In some embodiments, the aerogel component can comprise aerogels chosen from polymeric aerogels, colloidal aerogels, and mixtures thereof.

Aerogels may be described, in general terms, as gels that have been dried to a solid phase by removing pore fluid. As used herein, an "aerogel" refers to a material that is generally a very low density ceramic solid, typically formed from a gel. The term "aerogel" is thus used to indicate gels that have been dried so that the gel shrinks little during drying, preserving its porosity and related characteristics. In contrast, "hydrogel" is used to describe wet gels in which pore fluids are aqueous fluids. The term "pore fluid" describes fluid contained within pore structures during formation of the pore element(s). Upon drying, such as by supercritical drying, aerogel particles are formed that contain a significant amount of air, resulting in a low density solid and a high surface area. In various embodiments, aerogels are thus low-density microcellular materials characterized by low mass densities, large specific surface areas and very high porosities. In particular, aerogels are characterized by their unique structures that comprise a large number of small inter-connected pores. After the solvent is removed, the polymerized material is pyrolyzed in an inert atmosphere to form the aerogel.

The aerogel component can be either formed initially as the desired sized particles, or can be formed as larger particles and then reduced in size to the desired size. For example, formed aerogel materials can be ground, or they can be directly formed as nano to micron sized aerogel particles.

Aerogel particles of embodiments may have porosities of from about 50 percent to about 99.9 percent, in which the aerogel can contain 99.9 percent empty space. In embodiments the aerogel particles have porosities of from about 50 percent to about 99.0 percent, or from 50 percent to about 98 percent. In embodiments, the pores of aerogel components may have diameters of from about 10 nm to about 500 nm, or from about 20 nm to about 400 nm or from about 50 nm to about 300 nm. In particular embodiments, aerogel components may have porosities of more than 50 percent with pores with diameters of less than 100 nm and even less than about 20 nm. In embodiments, the aerogel components may be in the form of particles having a shape that is spherical, or near-spherical, cylindrical, rod-like, bead-like, cubic, platelet-like, and the like.

In embodiments, the aerogel components include aerogel particles, powders, or dispersions ranging in average volume particle size of from about 1 μm to about 100 μm, or about 3 μm to about 50 μm, or about 5 μm to 20 μm. The aerogel components can include aerogel particles that appear as well dispersed single particles or as agglomerates of more than one particle or groups of particles within the polymer material.

Generally, the type, porosity, pore size, and amount of aerogel used for a particular embodiment may be chosen based upon the desired properties of the resultant composition and upon the properties of the polymers and solutions thereof into which the aerogel is being combined. For example, if a pre-polymer (such as a low molecular weight polyurethane monomer that has a relatively low process viscosity, for example less than 10 centistokes) is chosen for use in an embodiment, then a high porosity, for example greater than 80%, and high specific surface area, for example greater than about 500 $m^2$/gm, aerogel having relatively small pore size, for example less than about 100 nm, may be mixed at relatively high concentrations, for example greater than about 2 weight percent to about 20 weight percent, into the pre-polymer by use of moderate-to-high energy mixing techniques, for example by controlled temperature, high shear and/or blending. If a hydrophilic-type aerogel is used, upon cross-linking and curing/post curing the pre-polymer to form an infinitely long matrix of polymer and aerogel filler, the resultant composite may exhibit improved hydrophobicity and increased hardness when compared to a similarly prepared sample of unfilled polymer. The improved hydrophobicity may be derived from the polymer and aerogel interacting during the liquid-phase processing whereby a portion of the molecular chain of the polymer interpenetrates into the pores of the aerogel and the non-pore regions of the aerogel serves to occupy some or all of the intermolecular space where water molecules could otherwise enter and occupy.

The continuous and monolithic structure of interconnecting pores that characterizes aerogel components also leads to high surface areas and, depending upon the material used to make the aerogel, the electrical conductivity may range from highly thermally and electrically conducting to highly thermally and electrically insulating. Further, aerogel components in embodiments may have surface areas ranging from about 400 $m^2$/g to about 1200 $m^2$/g, such as from about 500 $m^2$/g to about 1200 $m^2$/g, or from about 700 $m^2$/g to about 900 $m^2$/g. In embodiments, aerogel components may have electrical resistivities greater than about $1.0\times10^{-4}$ Ω-cm, such as in a range of from about 0.01 Ω-cm to about $1.0\times10^{16}$ Ω-cm, from about 1 Ω-cm to about $1.0\times10^{8}$ Ω-cm, or from about 50 Ω-cm to about 750,000 Ω-cm. Different types of aerogels used in various embodiments may also have electrical resistivities that span from conductive, about 0.01 to about 1.00 Ω-cm, to insulating, more than about $10^{16}$ Ω-cm. Conductive aerogels of embodiments, such as carbon aerogels, may be combined with other conductive fillers to produce combinations of physical, mechanical, and electrical properties that are otherwise difficult to obtain.

Aerogels that can suitably be used in embodiments may be divided into three major categories: inorganic aerogels, organic aerogels and carbon aerogels. In embodiments, the fuser member layer may contain one or more aerogels chosen from inorganic aerogels, organic aerogels, carbon aerogels and mixtures thereof. For example, embodiments can include multiple aerogels of the same type, such as combinations of two or more inorganic aerogels, combinations of two or more organic aerogels, or combinations of two or more carbon aerogels, or can include multiple aerogels of different types, such as one or more inorganic aerogels, one or more organic aerogels, and/or one or more carbon aerogels. For example, a chemically modified, hydrophobic silica aerogel may be combined with a high electrical conductivity carbon aerogel to simultaneously modify the hydrophobic and electrical properties of a composite and achieve a desired target level of each property.

Inorganic aerogels, such as silica aerogels, are generally formed by sol-gel polycondensation of metal oxides to form highly cross-linked, transparent hydrogels. These hydrogels are subjected to supercritical drying to form inorganic aerogels.

Organic aerogels are generally formed by sol-gel polycondensation of resorcinol and formaldehyde. These hydrogels are subjected to supercritical drying to form organic aerogels.

Carbon aerogels are generally formed by pyrolyzing organic aerogels in an inert atmosphere. Carbon aerogels are composed of covalently bonded, nanometer-sized particles that are arranged in a three-dimensional network. Carbon aerogels, unlike high surface area carbon powders, have oxygen-free surfaces, which can be chemically modified to increase their compatibility with polymer matrices. In addition, carbon aerogels are generally electrically conductive, having electrical resistivities of from about 0.005 Ω-cm to about 1.00 Ω-cm. In particular embodiments, the composite may contain one or more carbon aerogels and/or blends of one or more carbon aerogels with one or more inorganic and/or organic aerogels.

Carbon aerogels that may be included in embodiments exhibit two morphological types, polymeric and colloidal, which have distinct characteristics. The morphological type of a carbon aerogel depends on the details of the aerogel's preparation, but both types result from the kinetic aggregation of molecular clusters. That is, nanopores, primary particles of carbon aerogels that may be less than 20 Å (Angstroms) and that are composed of intertwined nanocrystalline graphitic ribbons, cluster to form secondary particles, or mesopores, which may be from about 20 Å to about 500 Å. These mesopores can form chains to create a porous carbon aerogel matrix. The carbon aerogel matrix may be dispersed, in embodiments, into polymeric matrices by, for example, suitable melt blending or solvent mixing techniques.

In embodiments, carbon aerogels may be combined with, coated, or doped with a metal to improve conductivity, magnetic susceptibility, and/or dispersibility. Metal-doped carbon aerogels may be used in embodiments alone or in blends with other carbon aerogels and/or inorganic or organic aerogels. Any suitable metal, or mixture of metals, metal oxides and alloys may be included in embodiments in which metal-doped carbon aerogels are used. In particular embodiments, and in specific embodiments, the carbon aerogels may be doped with one or more metals chosen from transition metals (as defined by the Periodic Table of the Elements) and aluminum, zinc, gallium, germanium, cadmium, indium, tin, mercury, thallium and lead. In particular embodiments, carbon aerogels are doped with copper, nickel, tin, lead, silver, gold, zinc, iron, chromium, manganese, tungsten, aluminum, platinum, palladium, and/or ruthenium. For example, in embodiments, copper-doped carbon aerogels, ruthenium-doped carbon aerogels and mixtures thereof may be included in the composite.

For example, as noted earlier, in embodiments in which the aerogel components comprise nanometer-scale particles, these particles or portions thereof can occupy inter- and intramolecular spaces within the molecular lattice structure of the polymer, and thus can prevent water molecules from becoming incorporated into those molecular-scale spaces. Such blocking may decrease the hydrophilicity of the overall composite. In addition, many aerogels are hydrophobic. Incorporation of hydrophobic aerogel components may also decrease the hydrophilicity of the composites of embodiments. Composites having decreased hydrophilicity, and any components formed from such composites, have improved environmental stability, particularly under conditions of cycling between low and high humidity.

The aerogel particles can include surface functionalities selected from the group of alkylsilane, alkylchlorosilane, alkylsiloxane, polydimethylsiloxane, aminosilane and methacrylsilane. In embodiments, the surface treatment material that contains functionality reactive to aerogel will result in modified surface interactions. [Please provide characteristics of surface treatment]. Surface treatment also helps enable non-stick interaction on the composition surface.

In addition, the porous aerogel particles may interpenetrate or intertwine with the fluoroplastic and thereby strengthen the polymeric lattice. The mechanical properties of the overall composite of embodiments in which aerogel particles have interpenetrated or interspersed with the polymeric lattice may thus be enhanced and stabilized.

For example, in one embodiment, the aerogel component can be a silica silicate having an average particle size of 5-15 microns, a porosity of 90% or more, a bulk density of 40-100 $kg/m^3$, and a surface area of 600-800 $m^2/g$. Of course, materials having one or properties outside of these ranges can be used, as desired.

Depending upon the properties of the aerogel components, the aerogel components can be used as is, or they can be chemically modified. For example, aerogel surface chemistries may be modified for various applications, for example, the aerogel surface may be modified by chemical substitution upon or within the molecular structure of the aerogel to have hydrophilic or hydrophobic properties. For example, chemical modification may be desired so as to improve the hydrophobicity of the aerogel components. When such chemical treatment is desired, any conventional chemical treatment well known in the art can be used. For example, such chemical treatments of aerogel powders can include replacing surface hydroxyl groups with organic or partially fluorinated organic groups, or the like.

In general, a wide range of aerogel components are known in the art and have been applied in a variety of uses. For example, many aerogel components, including ground hydrophobic aerogel particles, have been used as low cost additives in such formulations as hair, skincare, and antiperspirant compositions. One specific non-limiting example is the commercially available powder that has already been chemically treated, Dow Corning VM-2270 Aerogel fine particles having a size of about 5-15 microns.

Described herein is a system for tuning gloss for oil-less fusing fixtures. Within this system as shown in FIG. 2, fuser members incorporate a composite topcoat material comprised of a high-performance fluoroplastic 26 and the addition of aerogel particles 27. The incorporation of aerogel particles 27 into a fuser topcoat or release layer 24 results in a surface morphology that is transferred to the printed toner, to result in a "matte image". By adjusting the level of aerogel incorporation, the gloss of the printed image can be tuned. The low surface energy of aerogel/fluoroplastic topcoats additionally enable oil-less printing. Provided herein is an oil-less fusing system include fuser rolls or belts enabling varying levels of gloss, whereby the customer is able to choose a fuser member for the desired gloss on print. The fused images on the print or substrate have a gloss level ranging from about 99 ggu to about 10 ggu, or from about 90 ggu to about 15 ggu, or from about 85 ggu to about 20 ggu.

For oil-less printing platforms, a lower gloss option is desirable for certain customers. Creating a "textured" surface on fused toner prints can result in images with a more matte image, and a low-cost option for lower gloss is the use of a suitable fusing member with surface morphology. A fusing topcoat material requirement is that printed gloss is tunable and reproducible based on the topcoat composition. A requirement for oil-less fusing is that any particles incorporated into the topcoat composition must not adversely affect release performance under stringent oil-less conditions. Contamination is commonly an issue when non-fluorinated particles are added to a fusing topcoat.

Types of potential fillers include silica, alumina, titania, zirconia, and carbon aerogel particles. Silica aerogel particles are most widely available, while carbon aerogel may have advantages in the fusing system due to conductivity. Porosity must be greater than 50 weight percent to be considered an aerogel, but is generally much higher. The porous morphology of aerogel particles results in surface texture on multiple scales; on the scale of the particles (micron scale), as well as on the scale of the pores; micoropores (less than 2 nm), mesopores (2-50 nm, majority), and macropores (greater than 50 nm).

The presence of aerogel particles dispersed in the fluoroplastic results in surface texture on the surface of the topcoat. The mechanism proposed is that while printing, the texture created with low density, incompressible aerogel particles covering a significant portion of the surface of the thermoplastic imprints a texture to the printed image. The micron-sized particle filler enables lower print gloss on the prints. Print gloss can be adjusted by varying the type and/or amount of aerogel particles incorporated into the fluoroplastic top coat material. In addition, the incorporation of aerogel particles does not affect oil-less fuser release due to the low surface-energy aerogel/fluoroplastic composition and morphology.

Fluoroplastics, described previously, are commonly processed from powders and then brought to melting temperature (300-400° C.) to form the coherent coating. When aerogel and fluoroplastic particles are combined and brought to melting temperature, a fused fluoroplastic matrix is produced with embedded aerogel particles.

Methods of processing aerogel/fluoroplastic composite coatings include powder coating, spray coating from solvent dispersion, flow coating and sleeve coating. The layer incorporates aerogel fillers particles dispersed throughout a fluoroplastic matrix in ratios of 0.1 weight percent to 20 weight percent. In embodiments, the amount of aerogel particles dispersed through the fluoroplastc matrix is from 0.5 weight percent to about 10 weight percent, or from about 1 weight percent to about 2.5 weight percent.

The method of spray coating involves dispersing a mixture of aerogel and fluoroplastic resin particles in a solvent that may be water; an alcohol such as methanol, ethanol, or isopropanol; a ketone such as actone, methyl ethyl ketone (MEK) or methyl isobutylketone (MIBK), or other suitable solvent. The dispersion can also contain dispersants, stabilizers, leveling agents, or other additives to improve dispersion quality or coating quality. Following dispersion of aerogel and fluoroplastic particles, the dispersion is sprayed onto a functional surface of fusing member, and following drying of the solvent, the component is heat treated to the required temperature to melt the fluoroplastic and cure the topcoat layer.

The method of powder coating involves combining aerogel and fluoroplastic resin powder and mixing by blending or another mixing system to produce a homogeneously mixed powder, then powder coating . . . .

Flow coating is performed by applying a polymer solution dispensed between a blade and rotating fuser roll surface (rpm range between 40-200). The polymer solution is approximately 10-30% total solids weight basis in a pre-metered coating flow, The blade provides flow leveling around the roll circumference of the fuser substrate. The dispensing head and metering blade traverses along the length of the roll having a speed of about 2-20 mm/s so that the entire roll surface is coated in a spiral pattern. Successful flow coating conducted in this manner depends on coating rheology, blade angle, tip pressure, traverse speed, dispense rate and/or other factors as known to one of ordinary skill in the field of liquid film coating.

The method of sleeve coating involves melting fluoroplastic powder and aerogel powder and extruding through a die. To apply the sleeve to the fusing member, the aerogel/fluororesin sleeve is expanded radially, extended over the roll or belt, and released to form the outer sleeve coating. An adhesive coating is optionally applied between the outer sleeve and functional layer, where the adhesive can act as a lubricant while applying the tube as the outer layer. Further details of sleeve production involve heating the fluoroplastic melting temperature, wherein the fluororesin could be PFA, PTFE, FEP, or another melt-processable Fluoroplastic. In preferred embodiments, the fluoroplastic is PFA. The fluororesin is melt-mixed with aerogel powder either by initial mixing of fluororplastic powder or pellets (or other raw form) and aerogel powders and melting and mixing together, or by initial melting of fluororplastic followed by addition of aerogel while mixing. The amount of Aerogel powder included in the composite composition is determined by the roughness of surface texture required, which further tunes the level of print gloss. Mixing is carried out preferably via a screw extruder while heating at a temperature between 300-400° C., or another temperature required to melt the desired fluoroplastic. The composite Aerogel/fluoroplastic tube is obtained by extrusion moulding. The composite mixture is extruded using a melt extruder into a die mould to produce the tube of the size and shape desired for the fusing sleeve. The tube is then cooled, removed from the mould, wound by a winding apparatus, and cut to the desired shape.

EXAMPLES

Aerogel+PFA Topcoat Formulation

Silica silicate VM2270 aerogel powder was obtained from Dow Corning. The powder contains 5-15 μm particles having greater than 90 percent porosity, 40-100 kg/m$^3$ bulk density, and 600-800 m$^2$/g surface area. Topcoat formulations were prepared composed of MP320 powder PFA from DuPont (particle size of greater than 15 μm), at 0, 1, 1.5, 2.5, and 5 weight percent loadings of VM2270 aerogel powder. The aeorgel powder was dispersed in 2-propanol. Total solids loading in dispersions were 20 weight perecent, and dispersion of solids in 2-propanol was aided by repeated sonication.

Dispersions of PFA and aerogel were sprayed onto silicone rubber coated Olympia cores using a Paashe airbrush. Multiple passes with the airbrush resulted in coating thicknesses between 20-40 μm. The topcoats were cured by heat treatment at 350° C. for 12-15 minutes in a Greive oven.

Surface Roughness and Roll Gloss

Figure 3:
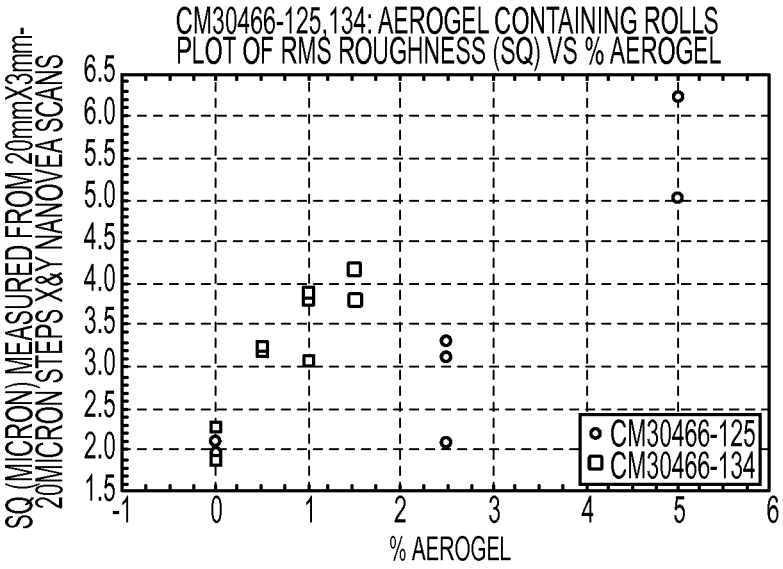
FIG. 3 shows surface gloss versus roll roughness for various fuser members.
Figure 4:
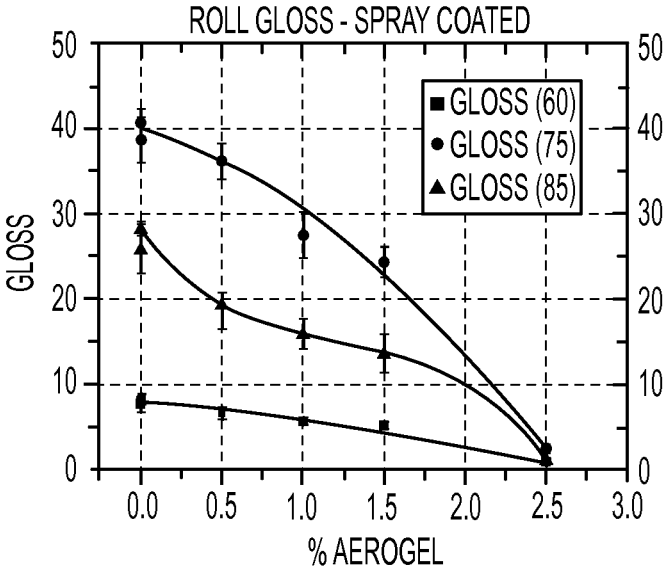
FIG. 4 shows roll gloss versus aerogel loading for various fuser member.

Surface roughness of coated fuser rolls was found to correlate with level of aerogel incorporation for PFA rolls containing between about 0.5 weight percent to about 5 weight percent silica aerogel. Variation was observed across test rolls, but the overall trend is increasing roughness, as shown in FIG. 3. FIG. 4 shows decreasing roll gloss with increasing level of incorporation of aerogel. Measurements were taken with a gloss meter, where the gloss values are given in gardener gloss units (ggu), where the measurements are taken using incidence angles of 60°, 75°, and 85°. Measurement taken at higher incidence angle are more sensitive to gloss changes and illustrate the dramatic gloss decrease of the roll surfaces with the incorporation of aerogel in amounts up to 2.5% of the composite surface.

Figure 5:
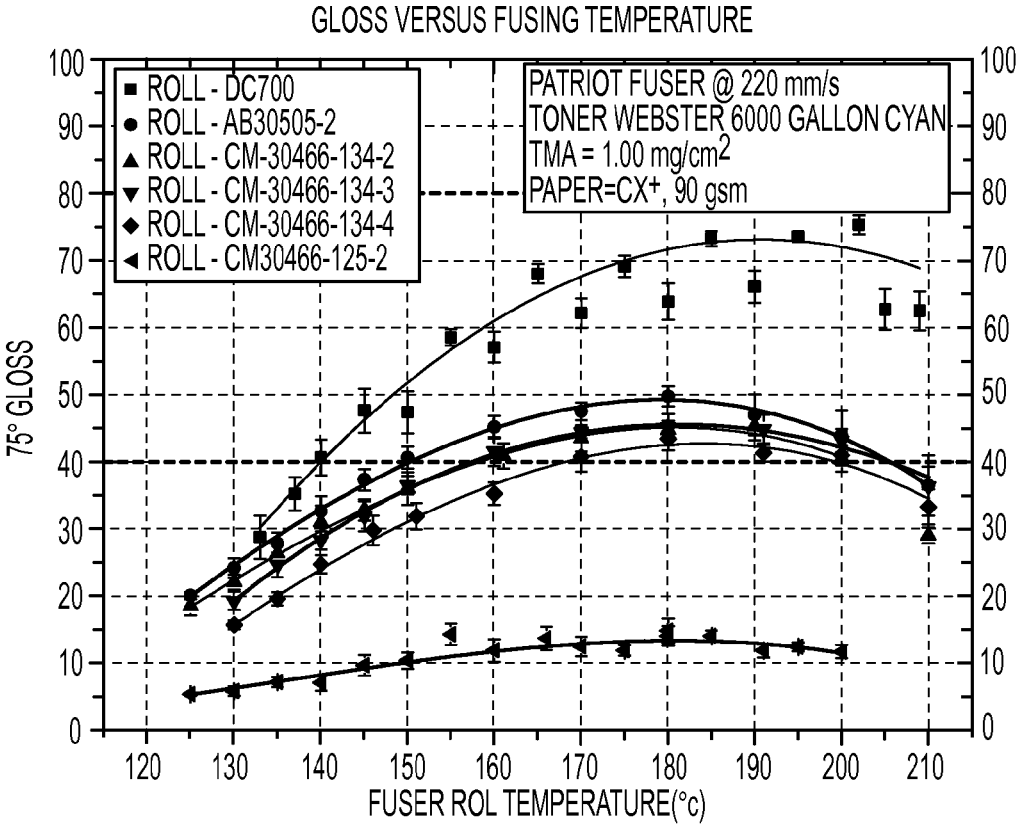
FIG. 5 shows print gloss versus temperature for various fuser members.
Figure 6:
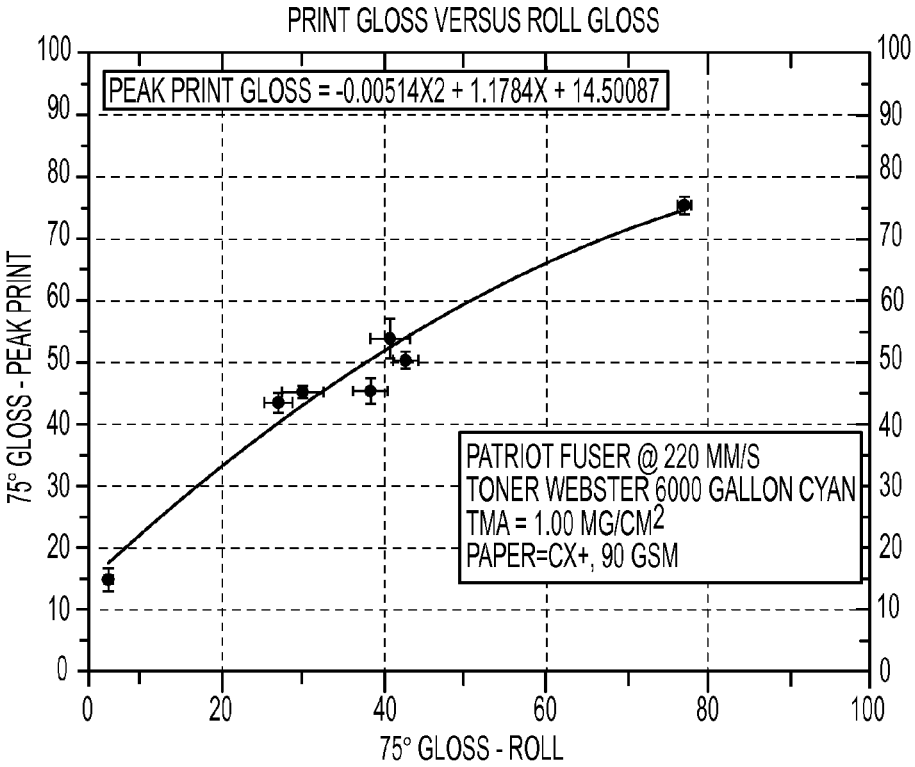
FIG. 6 shows print gloss versus roll gloss for various fuser members.

Initial fusing performance of the coated fuser rolls is carried out using a DC700 fusing fixture. A motor controller, temperature sensors and temperature controller were attached to a modified fuser CRU. Unfused images are generated offline before being sent through the fusing fixture. The test images are generated using a modified DC12 with DC700 toner on Xerox Color Xpressions+90 gsm paper. For these tests the print speed was set to 220 mm/s and fuser roll temperature was varied from 125° C. to 210° C. The wide range in temperature allows the upper and lower limits of the fusing space to be determined. After fusing the print sample gloss is measured using a BYK Gardner 75 degree micro-Gloss meter. Three gloss readings are taken parallel to the process direction and three readings perpendicular to the process direction are measured for each print sample. An example of the range in print gloss found for the various rolls is shown in FIG. 5. The composite fuser topcoat containing 2.5% Aerogel displays very low gloss ~10 ggu, a value that is at the lower limit for a desirable matte image. From this data, it is anticipated that gloss can be tuned by aerogel incorporation between 0.5 weight percent to about 2.5 weight percent. FIG. 6 displays good correlation between print gloss and gloss on rolls.

SEM/EDS Characterization of Coatings/Prints

Figure 7:
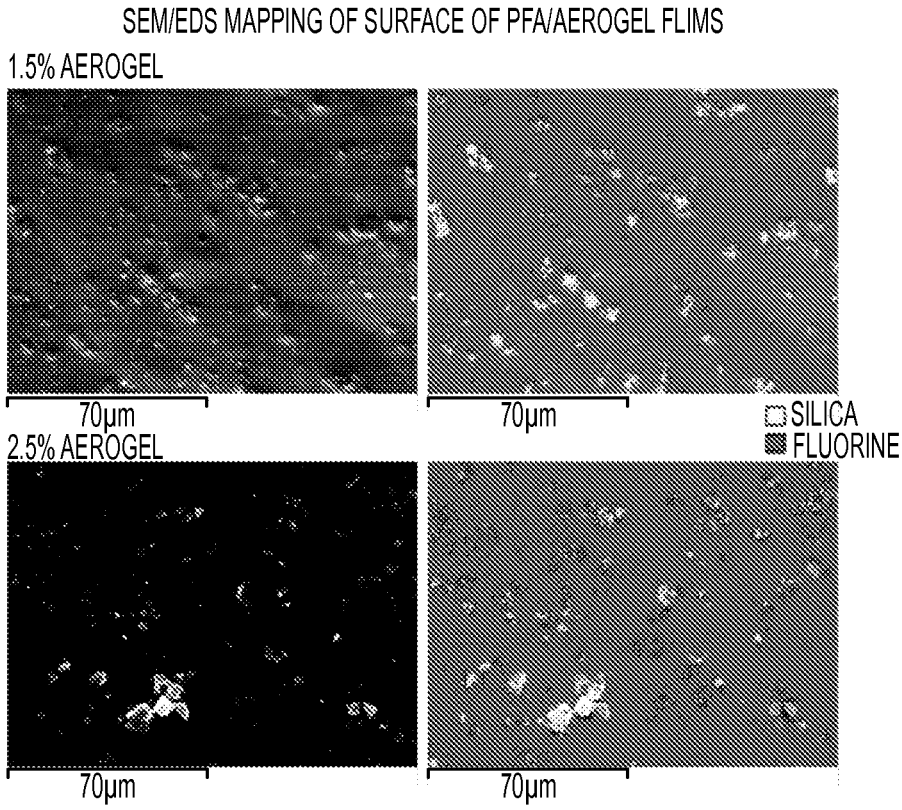
FIG. 7 show SEM images of the surface of fuser members.
Figure 8:
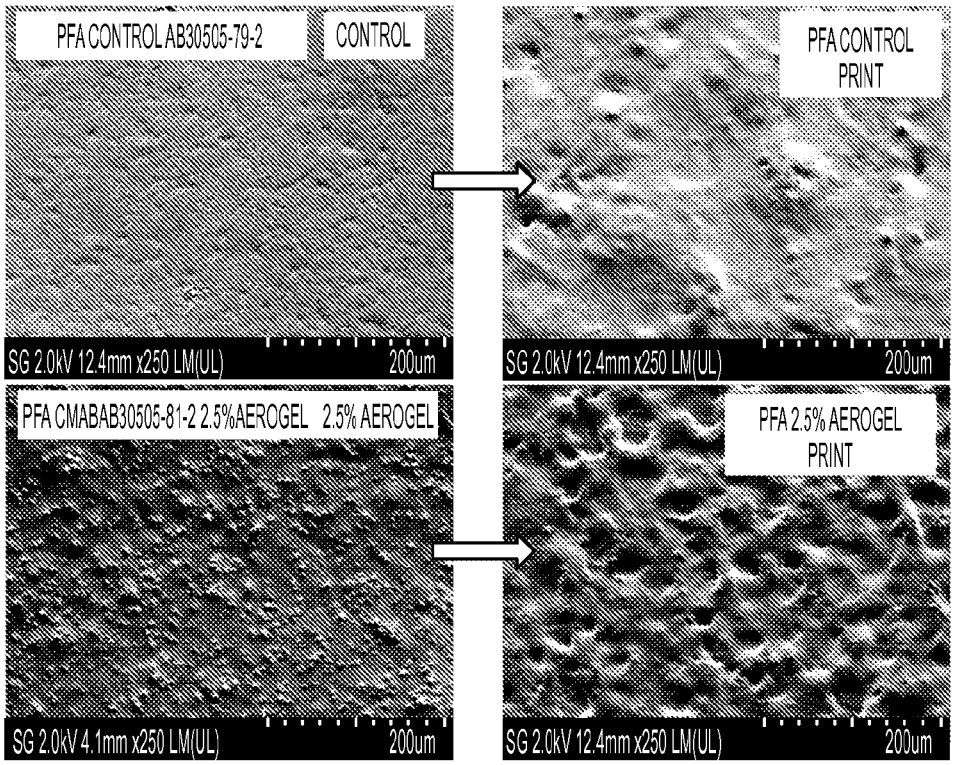
FIG. 8 show SEM images of the surface of fuser members.

SEM and EDS imaging display homogeneous dispersion of aerogel particles. FIG. 7 shows SEM images of PFA/aerogel coatings at about 1.5 weight percent and about 2.5 weight percent loadings of aerogel particles, wherein the about 10 micron sized aerogel particles are observable. EDS measurement confirms dispersion of silica aerogel particles across the coatings. FIG. 8 shows images of PFA/aerogel coatings and corresponding prints. The print generated from a 2.5 weight percent aerogel fusing surface is highly textured, and this morphology is attributed as the source of the matting effect observed on prints.

Image Quality

Changes in image quality of the prints have not been observed for prints generated from topcoats incorporating from about 1 weight percent to about 2.5 weight percent aerogel particles. Images produced using a current DC700 roll, compared with a 2.5 weight percent aerogel "matte" roll revealed no change in image quality.

Toner Release

Release of toner under oil-less fusing conditions has been maintained for print tests carried out to date using aerogel/PFA fuser rolls. No contamination of toner or other contaminants has been noted on fuser roll surfaces. Moreover, surface energy measurements of aerogel/PFA coatings on silicone substrate indicate that surface energy is decreased as silica aerogel is incorporated, as shown in Table 1. It is expected that a decrease in surface energy, likely arising from the morphology created at the surface, will aid to decrease contamination and improve release.

TABLE 1

| Sample ID | LW | − | + | total |
|---|---|---|---|---|
| CM 30466 0% aerogel | 15.64 | 1.279 | 0.804 | 17.67 |
| CM 30466 2.5% aerogel | 12.39 | 1.041 | 1.493 | 14.89 |
| CM 30466 5% aerogel | 5.389 | 1.572 | 1.504 | 8.465 |

Mechanical Properties

Coatings were prepared for bulk mechanical properties testing by spray-coating dispersions of 0, 1.5, 2.5, and 5 weight percent silica aerogel/PFA powders in 2-propanol, at 20 weight percent solids loading, onto metal substrates. The coatings were heat treated at 350° C. for 20 minutes, and free-standing thick films were then peeled from the substrates. Mechanical testing was conducted with an Instron Model 3367 with a temperature chamber, using the ASTM D638 (plastics) test method at 180° C. (fusing temperature). Samples were equilibrated at temperature 15 minutes prior to testing.

Mechanical properties results observed were typical for filler-reinforced plastics, with an increase in modulus with addition of silica aerogel powder, and corresponding decrease in stress, strain, and toughness. At 1.5 weight percent and 2.5 weight percent aerogel loading, the coatings maintain strength, flexibility and cohesion. At 5 weight percent aerogel loading, free-standing films exhibit loss of cohesion and strength. Therefore, at les than or equal to 2.5 weight percent loadings of aerogel for films prepared using spray coating, mechanical properties are maintained. This range also corresponds with the range of interest for tuning print gloss. It is important to note that while mechanical results indicate trends, values do not always correlate with topcoat performance, which can extend beyond the range indicated by Instron testing and are also dependent on many factors, including processing conditions.

It will be appreciated that variants of the above-disclosed and other features and functions or alternatives thereof may be combined into other different systems or applications. Various presently unforeseen or unanticipated alternatives, modifications, variations, or improvements therein may be subsequently made by those skilled in the art, which are also encompassed by the following claims.

What is claimed is:

1. A method of tuning gloss level on a copy substrate comprising:

obtaining an image forming apparatus for forming images on a recording medium comprising a charge-retentive surface to receive an electrostatic latent image thereon;

applying toner to the charge-retentive surface to develop an electrostatic latent image to form a developed image on the charge-retentive surface;

transferring the developed image from the charge retentive surface to a copy substrate;

fusing toner images to a surface of the copy substrate;

adjusting gloss on the copy substrate by providing a fuser member having a surface layer comprising a fluoroplastic matrix having dispersed therein aerogel particles wherein the greater a weight percent of the aerogel particles in the fluoroplastic matrix the lower the gloss.

2. The method of claim 1, wherein the fluoroplastic matrix is selected from the group consisting of polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP).

3. The method of claim 1, wherein the aerogel particles are selected from the group consisting of silica, carbon, alumina, titania and zirconia.

4. The method of claim 1, wherein the aerogel particles comprise a surface area of from about 400 $m^2/g$ to about 1000 $m^2/g$.

5. The method of claim 1, wherein the aerogel particles comprise a particle size of from about 1 μm to about 100 μm.

6. The method of claim 1, wherein the aerogel particles have been surface treated with a functional group selected form the group consisting of alkylsilane, alkylchlorosilane, alkylsiloxane, polydimethylsiloxane, aminosilane and methacrylsilane.

7. The method of claim 1, wherein the weight percent of aerogel particles in the fluoroplastic matrix is from about 0.1 weight percent to about 10 weight percent.

8. The method of claim 1, wherein the weight percent of aerogel particles in the fluoroplastic matrix is from about 0.1 weight percent to about 2.5 weight percent.

9. The method of claim 1, wherein surface layer comprises a root mean square surface roughness of from about 1 to about 12.

10. The method of claim 1, wherein the surface layer is formed by spray coating.

11. The method of claim 1, wherein the surface layer is formed by powder coating.

12. A fusing system comprising:

a fuser member comprising a gloss-controlling surface layer wherein the surface layer comprises a fluoroplastic matrix having dispersed therein aerogel particles wherein the aerogel particles comprise from about 0.5 weight percent to about 5.0 weight percent of the surface layer; and a pressure member configured to form a nip with the fuser member surface layer to fuse images on a substrate that passes through the nip wherein the fused images on the substrate have a gloss level ranging from about 99 ggu to about 10 ggu.

13. The fusing system of claim 12, wherein the fluoroplastic matrix comprises a material selected from the group consisting of polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP).

14. The fusing system of claim 12, wherein the aerogel particles are selected from the group consisting of silica, carbon, alumina, titania and zirconia.

15. The fusing system of claim 12, wherein the aerogel particles comprise a surface area of from about 400 $m^2/g$ to about 1000 $m^2/g$.

16. The fusing system of claim 12, wherein the aerogel particles comprise a particle size of from about 1 μm to about 100 μm.

17. A fusing method comprising:

passing a substrate between a fusing member and a pressure member wherein the fusing member comprises a surface layer comprising a fluoroplastic matrix having dispersed therein silca aerogel particles, wherein the aerogel particles comprise from about 0.5 weight percent to about 2.5 weight percent of the surface layer such that a toner image is fused onto the substrate wherein the fused toner image comprises a gloss level ranging from about 90 ggu to about 10 ggu.

18. The fusing method of claim 17, wherein the fluoroplastic matrix comprises a material selected from the group consisting of polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP).

19. The fusing method claim 17, wherein the aerogel particles comprise a surface area of from about 400 $m^2/g$ to about 1000 $m^2/g$.

20. The fusing method of claim 17, wherein the aerogel particles comprise a particle size of from about 1 μm to about 100 μm.

* * * * *